US010119180B2

(12) United States Patent
Guedou et al.

(10) Patent No.: US 10,119,180 B2
(45) Date of Patent: Nov. 6, 2018

(54) TITANIUM-BASED INTERMETALLIC ALLOY

(71) Applicant: SAFRAN AIRCRAFT ENGINES, Paris (FR)

(72) Inventors: Jean-Yves Guedou, Moissy-Cramayel (FR); Jean-Michel Patrick Maurice Franchet, Moissy-Cramayel (FR); Jean-Loup Bernard Victor Strudel, Cerny (FR); Laurent Germann, Morteau (FR); Dipankar Banerjee, Bangalore (IN); Vikas Kumar, Kanchanbagh (IN); Tapash Nandy, Hyderabad (IN)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 15/538,119

(22) PCT Filed: Dec. 14, 2015

(86) PCT No.: PCT/FR2015/053481

§ 371 (c)(1),
(2) Date: Jun. 20, 2017

(87) PCT Pub. No.: WO2016/102806

PCT Pub. Date: Jun. 30, 2016

(65) Prior Publication Data

US 2017/0342524 A1 Nov. 30, 2017

(30) Foreign Application Priority Data

Dec. 22, 2014 (FR) ..... 14 63066

(51) Int. Cl.
*C22C 14/00* (2006.01)
*C22C 1/04* (2006.01)

(52) U.S. Cl.
CPC ..... *C22C 14/00* (2013.01); *C22C 1/0458* (2013.01); *C22C 1/0491* (2013.01)

(58) Field of Classification Search
CPC ..... C22C 14/00
(Continued)

(56) References Cited

U.S. PATENT DOCUMENTS 4,716,020 A 12/1987 Blackburn et al.
5,032,357 A 7/1991 Rowe
6,132,526 A * 10/2000 Carisey ..... C22C 14/00 148/407

FOREIGN PATENT DOCUMENTS

CN 1632147 A 6/2005
CN 103143709 A 6/2013
(Continued)

OTHER PUBLICATIONS

International Search Report as issued in International Patent Application No. PCT/FR2015/053481, dated Mar. 8, 2016.
(Continued)

*Primary Examiner* — Brian D Walck
(74) *Attorney, Agent, or Firm* — Pillsbury Winthrop Shaw Pittman LLP

(57) ABSTRACT

A titanium-based intermetallic alloy includes, in atomic percent, 16% to 26% Al, 18% to 28% Nb, 0% to 3% of a metal M selected from Mo, W, Hf, and V, 0.1% to 2% of Si, 0% to 2% of Ta, 1% to 4% of Zr, with the condition Fe+Ni≤400 ppm, the balance being Ti, the alloy also presenting an Al/Nb ratio in atomic percent lying in the range 1.05 to 1.15.

10 Claims, 3 Drawing Sheets

(58) Field of Classification Search
USPC ..... 148/421; 420/418
See application file for complete search history.

(56) References Cited

FOREIGN PATENT DOCUMENTS

| | | |
|---|---|---|
| EP | 0 539 152 A1 | 4/1993 |
| EP | 0 924 308 A1 | 6/1999 |
| FR | 2 772 790 A1 | 6/1999 |

OTHER PUBLICATIONS

International Preliminary Report on Patentability and the Written Opinion of the International Searching Authority as issued in International Patent Application No. PCT/FR2015/053481, dated Jun. 27, 2017.

* cited by examiner

TITANIUM-BASED INTERMETALLIC ALLOY

CROSS REFERENCE TO RELATED APPLICATIONS

This application is the U.S. National Stage of PCT/FR2015/053481 filed Dec. 14, 2015, which in turn claims priority to French Application No. 1463066, filed Dec. 22, 2014. The contents of both applications are incorporated herein by reference in their entirety.

BACKGROUND OF THE INVENTION

The invention relates to intermetallic alloys based on titanium.

Titanium-based intermetallic alloys of the $Ti_2AlNb$ type are disclosed in application FR 97/16057. Such alloys present a high elastic limit up to 650° C., and high resistance creep at 550° C., and good ductility at ambient temperature. Nevertheless, those alloys can present resistances to creep and to oxidation at high temperature (650° C. and above) that are insufficient for certain applications in turbomachines, such as downstream disks or the impellers of high pressure compressors. Those parts constitute the hottest rotary parts of the compressor and they are generally made of a nickel alloy of specific gravity greater than 8, which can be penalizing for the weight of the machine.

Consequently, there exists a need for novel titanium-based alloys of $Ti_2AlNb$ type presenting improved resistance to creep at high temperature.

There also exists a need for novel titanium-based alloy of $Ti_2AlNb$ type presenting improved resistance to oxidation at high temperature.

There still exists the need for new titanium-based alloys of $Ti_2AlNb$ type.

OBJECT AND SUMMARY OF THE INVENTION

To this end, in a first aspect, the invention provides a titanium-based intermetallic alloy comprising, in atomic percent, 16% to 26% Al, 18% to 28% Nb, 0% to 3% of a metal M selected from Mo, W, Hf, and V, 0% to 0.8% of Si or 0.1% to 2% of Si, 0% to 2% of Ta, 0% to 4% of Zr, with the condition Fe+Ni≤400 parts per million (ppm), the balance being Ti.

By having the low content of the elements Fe and Ni, the alloy of the invention advantageously presents improved resistance to creep at high temperature.

Such an alloy may advantageously present an elastic limit greater than 850 megapascals (MPa) at a temperature of 550° C., high resistance to creep in the range 550° C. to 650° C., together with ductility greater than 3.5% and an elastic limit greater than 1000 MPa at ambient temperature. The term "ambient temperature" should be understood as being a temperature of 20° C.

Unless specified to the contrary, if a plurality of metals M selected from Mo, W, Hf, and V are present in the alloy, it should be understood that the sum of the contents in atomic percent for each of the metals present lies within the specified range of values. For example, if Mo and W are present in the alloy, the sum of the atomic percent content of Mo plus the atomic percent of W lies in the range 0% to 3%.

The tantalum present at atomic contents lying in the range 0 to 2% serves advantageously to reduce the kinetics of oxidation and to increase the resistance to creep of the alloy.

In an embodiment, the alloy may satisfy, in atomic percent, the following conditions: Fe+Ni≤350 ppm, e.g. Fe+Ni≤300 ppm. In an embodiment, the alloy may satisfy, in atomic percent, the following condition: Fe+Ni+Cr≤350 ppm, e.g. Fe+Ni+Cr≤300 ppm. Preferably, the alloy may satisfy, in atomic percent, the following conditions: Fe≤200 ppm, e.g. Fe≤150 ppm, e.g. Fe≤100 ppm.

Preferably, the Al/Nb ratio in atomic percent may lie in the range 1 to 1.3, e.g. in the range 1 to 1.2.

Such an Al/Nb ratio serves advantageously to improve the resistance of the alloy to oxidation when hot.

Preferably, the Al/Nb ratio in atomic percent lies in the range 1.05 to 1.15.

Such an Al/Nb ratio serves to give the alloy good resistance to oxidation when hot.

Preferably, the alloy may include 20% to 22% of Nb, in atomic percent. Such contents of Nb advantageously give the alloy improved resistance to oxidation, improved ductility, and also improved mechanical strength.

In an embodiment, the alloy may include 22% to 25% Al, in atomic percent. Such contents advantageously give the alloy improved resistance to creep and improved resistance to oxidation.

Preferably, the alloy may include 23% to 24% Al, in atomic percent. Such contents advantageously give the alloy improved ductility and improved resistance to creep and to oxidation.

In an embodiment, the alloy may include 0.1% to 2% Si, e.g. 0.1% to 0.8% Si, in atomic percent. Preferably, the alloy may include 0.1% to 0.5% Si, in atomic percent.

Such contents of Si advantageously improve the resistance to creep of the alloy while conferring good resistance to oxidation thereto.

In an embodiment, the alloy may include 0.8% to 3% of M, in atomic percent. Preferably, the alloy may include 0.8% to 2.5% of M, preferably 1% to 2% of M, in atomic percent.

Such contents of metal M advantageously improve the hot strength of the alloy.

In an embodiment, the alloy may include 1% to 3% of Zr, in atomic percent. Preferably, the alloy may include 1% to 2% of Zr, in atomic percent.

Such contents of Zr advantageously improve the resistance to creep, mechanical strength above 400° C., and also the resistance to oxidation of the alloy.

In an embodiment, the alloy may be such that the following condition is satisfied in atomic percent: M+Si+Zr+Ta≥0.4%, e.g. M+Si+Zr+Ta≥1%.

Such contents advantageously improve the mechanical strength of the alloy when hot.

In an embodiment, the alloy may be such that:

- the content of Al lies in the range 20% to 25%, in atomic percent, preferably in the range 21% to 24%;
- the content of Nb lies in the range 20% to 22%, in atomic percent, preferably in the range 21% to 22%, the Al/Nb ratio in atomic percent lying in the range 1 to 1.3, preferably 1 to 1.2, more preferably 1.05 to 1.15;
- the content of M lies in the range 0.8% to 3%, in atomic percent, preferably in the range 0.8% to 2.5%, more preferably in the range 1% to 2%; and
- the content of Zr lies in the range 1% to 3%, in atomic percent;

the alloy optionally being such that the content of Si lies in the range 0.1% to 2%, e.g. 0.1% to 0.8%, preferably in the range 0.1% to 0.5%, in atomic percent.

Such an alloy advantageously presents:

- high mechanical strength in traction at 650° C. (R=1050 MPa−$R_{0.2}$=900 MPa);

good resistance to creep at high temperature (1% elongation after 150 hours at 650° C. under stress of 500 MPa);

good resistance to oxidation when hot; and good ductility at ambient temperature (>3.5%).

Table 1 below gives the compositions of example alloys S1 to S12 of the invention. All of these compositions satisfy the following condition Fe+Ni≤400 ppm, in atomic percent.

TABLE 1

| Alloy | Al | Nb | Mo | Si | Zr | Al/Nb | Specific gravity | Tβ (° C.) |
|---|---|---|---|---|---|---|---|---|
| S1 | 22 | 25 | | | | 0.88 | 5.29 | 1065 |
| S2 | 22 | 25 | | 0.5 | | 0.88 | 5.28 | 1058 |
| S3 | 22 | 25 | 1 | | | 0.88 | 5.34 | 1055 |
| S4 | 22 | 25 | 1 | 0.5 | | 0.88 | 5.34 | 1065 |
| S5 | 24 | 25 | | | | 0.96 | 5.29 | 1085 |
| S6 | 22 | 20 | | | | 1.10 | 5.09 | 1055 |
| S7 | 22 | 23 | 1.5 | 0.2 | | 0.95 | 5.39 | 1060 |
| S8 | 20 | 25 | 1 | | | 0.80 | 5.41 | 1025 |
| S9 | 22 | 25 | 1.5 | | 2 | 0.88 | 5.50 | 1025 |
| S10 | 20 | 23 | 2 | | 2 | 0.87 | 5.43 | 1000 |
| S11 | 24.5 | 20 | 1.5 | 0.25 | | 1.21 | 5.16 | 1105 |
| S12 | 23 | 21.5 | 1.5 | 0.25 | 1.3 | 1.07 | 5.30 | 1005 |

The invention also provides a turbomachine fitted with a part including, and in particular made of, an alloy as defined above. By way of example, the part may be a casing or a rotary part.

The invention also provides an engine including a turbomachine as defined above.

The invention also provides an aircraft including an engine as defined above.

BRIEF DESCRIPTION OF THE DRAWINGS

Other characteristics and advantages of the invention appear from the following description given with reference to the accompanying drawings, in which.

EXAMPLES

Example 1

Fabricating an Alloy of the Invention

Starting from raw materials constituted by titanium sponges and granules of parent alloys, a mixture was prepared to obtain the chemical composition S12 set out in Table 1 above. The powder mixture was then homogenized and then compressed in order to constitute a compact constituting an electrode. The electrode was then remelted in a vacuum by creating an electric arc between the electrode, which is consumed, and the bottom of a water-cooled crucible (a technique known as vacuum arc remelting (VAR)). The resulting ingot was then reduced into a bar by deformation at high speed (by pestle forging or by extrusion) in order to reduce grain size. The last step was isothermal forging of slugs cut off from the bar at a temperature immediately below the β transus temperature with deformation at low speed (a few $10^{-3}$).

Such an alloy of S12 composition, which contains 1.3% zirconium, presents very good resistance to oxidation when hot. Specifically, this alloy does not present spalling after being exposed to air at 700° C. for 1500 hours, with an oxide layer made of alumina and zirconia being formed that is fine and very adherent, and thus protective. Alloys not containing zirconium can present less good resistance to oxidation when hot.

Example 2

Improving the Resistance to Creep When Hot by Using a Limited Content of Fe+Ni The resistances to creep of three alloy compositions P1, P2, and P3 set out in Table 2 has been compared.

TABLE 2

| Composition at % | Ti | Al | Nb | Mo | Fe | Ni |
|---|---|---|---|---|---|---|
| Alloy P1 | 55.2 | 23.9 | 20.3 | 0.40 | 0.09 | 0.01 |
| Alloy P2 | 53.9 | 25.3 | 20.3 | 0.40 | 0.07 | 0.01 |
| Alloy P3 | 55.5 | 23.8 | 20.3 | 0.40 | 0.01 | 0.02 |

Figure 1:
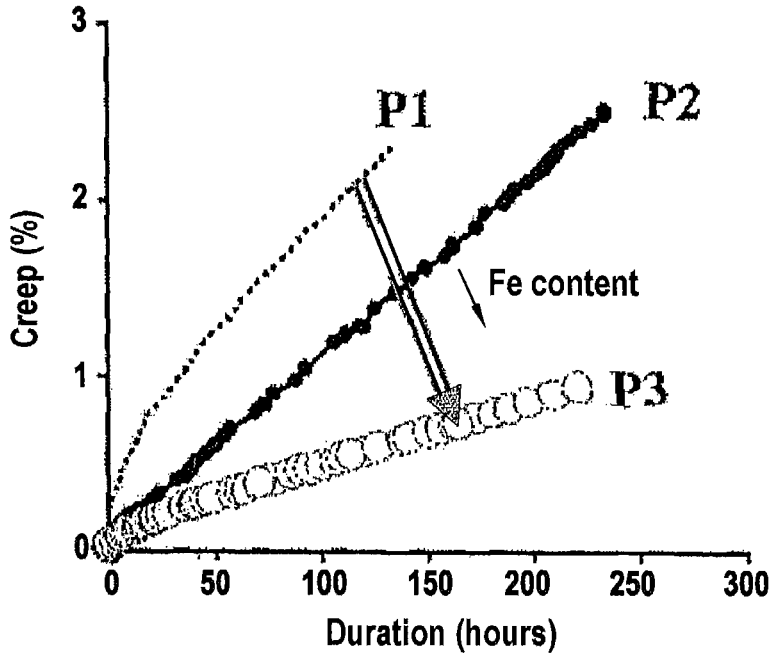
FIG. 1 shows the variation in creep resistance of various alloys at 650° C. under a stress of 310 MPa.

Those alloys include Fe and Ni trace elements which are present in the form of impurities, and which result naturally from the fabrication method. The elements Fe and Ni are impurities coming from the stainless steel container used for preparing titanium powders. It is thus preferable to use a titanium powder of great purity taken from the center of the volume defined by the container, where the pollution coming from the walls is negligible in order to be sure of obtaining the condition Fe+Ni≤400 ppm. As shown in FIG. 1, an improvement in resistance to creep at 650° C. under stress of 310 MPa is observed when the contents of trace elements are reduced so as to satisfy the relationship Fe+Ni≤400 ppm. Specifically, as shown in FIG. 1, creep reached 1% after 250 hours with an alloy of the invention (P3), whereas this value of creep was reached after only 40 hours with a prior art alloy (P1).

Example 3

Improving the Resistance to Corrosion While Hot by Using Al/Nb at an Atomic Percent Ratio Lying in the Range 1 to 1.3

Figure 2:
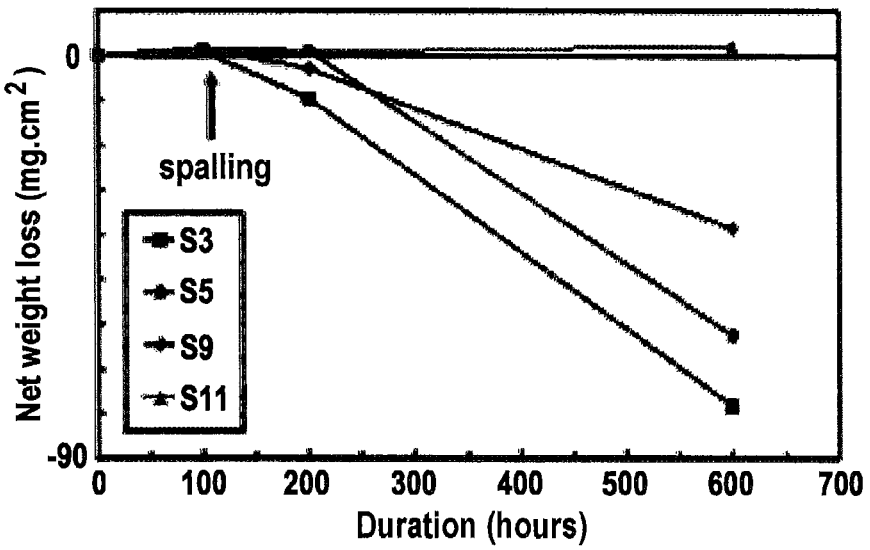
FIG. 2 shows the influence of the Al/Nb ratio on the resistance to oxidation when hot.

The resistance to corrosion when hot of various alloys has been compared. The results are given in FIG. 2. The compositions of alloys S3, S5, S9, and S11 are given above in Table 1.

During this testing, the change in weight as a result of the surface of the alloy spalling was measured. This test shows the resistance to oxidation of the alloys at 800° C. It can be seen that a loss of weight associated with metal being consumed by oxidation is observed for the alloys S3, S5, and S9 which do not present an Al/Nb ratio lying in the range 1 to 1.3. In contrast, this loss of weight does not occur with the alloy S11, which presents an Al/Nb ratio in the range 1 to 1.3.

Example 4

Figure 3A:
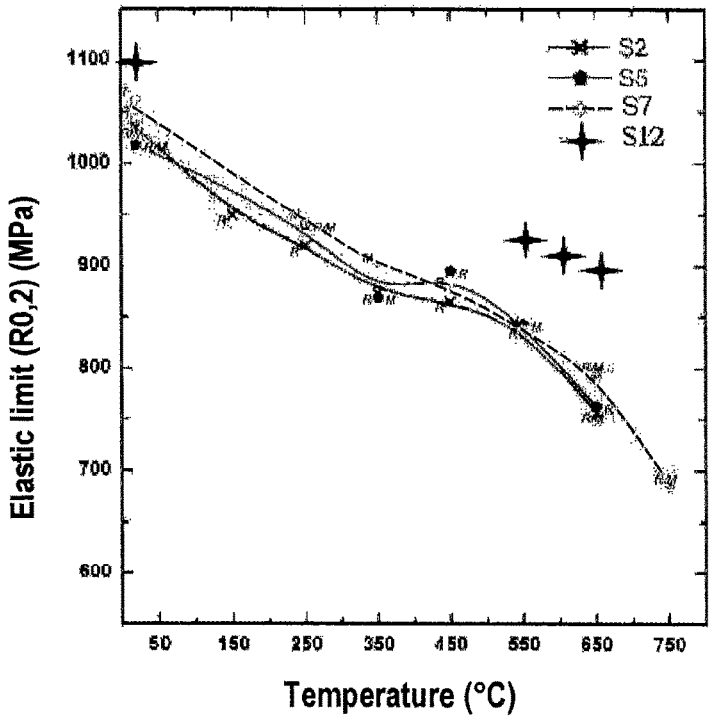
FIGS. 3A to 3D show results obtained in terms of mechanical properties for a preferred alloy of the invention.
Figure 3B:
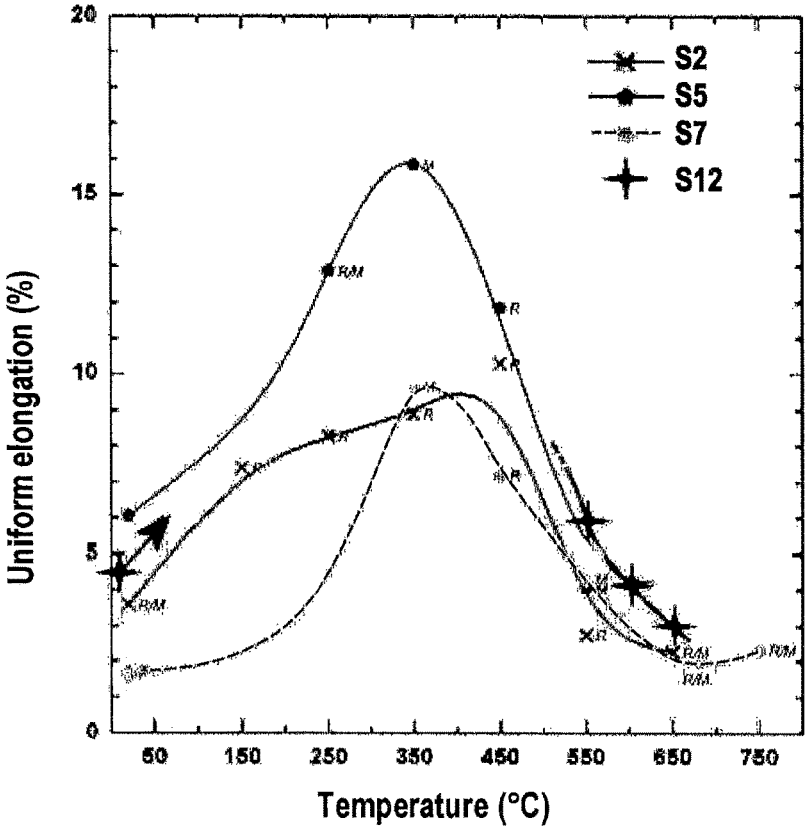
Figure 3C:
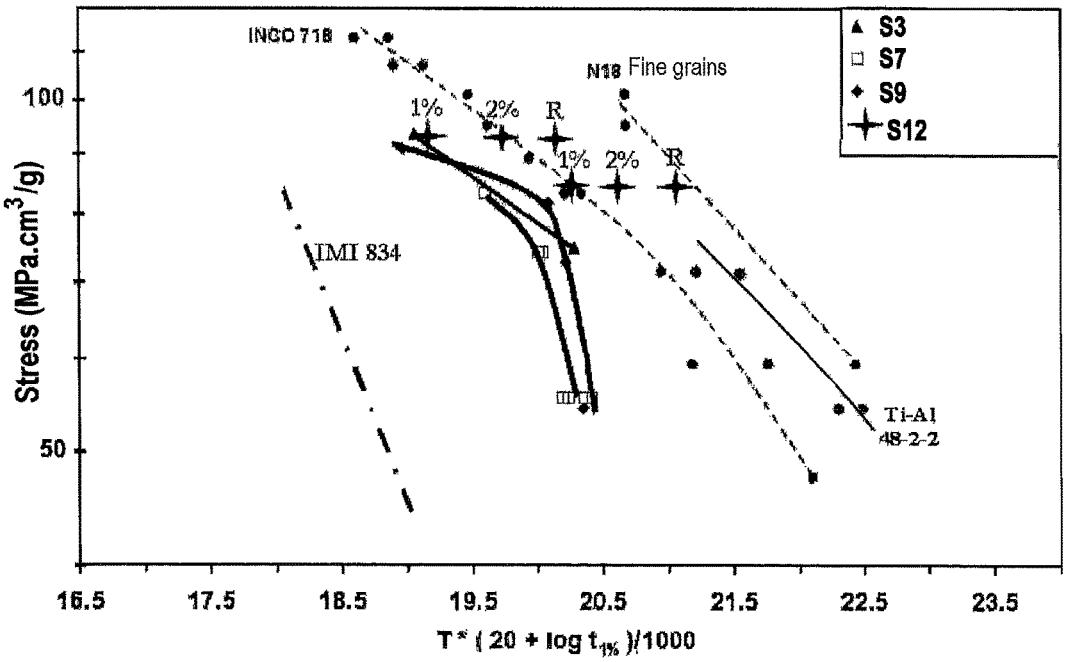
Figure 3D:
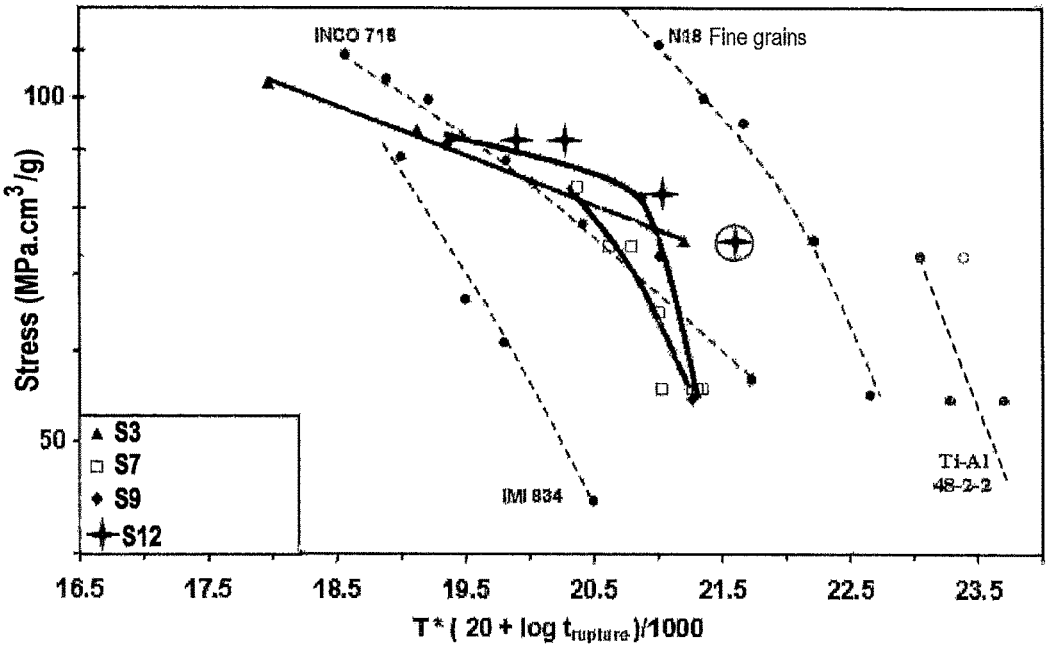

Comparing the Performance of the Alloy Fabricated in Example 1 With Other Types of Alloy The results of tests grouped together in FIGS. 3A and 3D show that the composition S12 presents good results both in traction and in creep. More particularly:

FIG. 3A shows, for various alloys how the elastic limit ($R_{0.2}$) varies as a function of temperature;

FIG. 3B shows, for various alloys, how elongation of rupture (ductility) varies as a function of temperature;

FIG. 3C compares creep (time for creep to reach 1%) of various alloys at temperatures of 600° C. and of 650° C.; and FIG. 3D compares times for creep rupture of various alloys at temperatures of 600° C. and 650° C.

The term "comprising a" should be understood as "comprising at least one".

The term "lying in the range . . . to . . . " should be understood as including the bounds.

The invention claimed is:

1. A titanium-based intermetallic alloy comprising, in atomic percent, 19.3% to 26% Al, 18% to 24.3% Nb, 0% to 3% of a metal M selected from Mo, W, Hf, and V, 0.1% to 2% of Si, 0% to 2% of Ta, 1% to 4% of Zr, with the condition Fe+Ni≤400 ppm, the balance being Ti, the alloy also presenting an Al/Nb ratio in atomic percent of about 1.07.

2. An alloy according to claim 1, comprising 20% to 22% Nb, in atomic percent.

3. An alloy according to claim 1, comprising 23% to 24% Al, in atomic percent.

4. An alloy according to claim 1, comprising 0.1% to 0.8% Si, in atomic percent.

5. An alloy according to claim 1 claim 1, comprising 0.8% to 3% of M, in atomic percent.

6. An alloy according to claim 1, comprising 1% to 3% Zr, in atomic percent.

7. An intermetallic alloy according to claim 1, wherein:

the content of Al lies in the range 20% to 25%, in atomic percent;

the content of Nb lies in the range 20% to 22%, in atomic percent;

the content of M lies in the range 0.8% to 3%, in atomic percent; and the content of Zr lies in the range 1% to 3%, in atomic percent.

8. A turbomachine including a part including an alloy according to claim 1.

9. An engine including a turbomachine according to claim 8.

10. An aircraft including an engine according to claim 9.

* * * * *